US008840406B2

(12) United States Patent
Hirata

(10) Patent No.: US 8,840,406 B2
(45) Date of Patent: Sep. 23, 2014

(54) TERMINALS

(75) Inventor: Toshihisa Hirata, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 171 days.

(21) Appl. No.: 13/515,210

(22) PCT Filed: Dec. 20, 2010

(86) PCT No.: PCT/US2010/061345

§ 371 (c)(1),
(2), (4) Date: Nov. 13, 2012

(87) PCT Pub. No.: WO2011/075733

PCT Pub. Date: Jun. 23, 2011

(65) Prior Publication Data

US 2013/0065460 A1 Mar. 14, 2013

(30) Foreign Application Priority Data

Dec. 18, 2009 (JP) ..... 2009-287405

(51) Int. Cl.
*H01R 12/00* (2006.01)
*H01R 12/71* (2011.01)
*H01R 13/26* (2006.01)

(52) U.S. Cl.
CPC ..... *H01R 12/716* (2013.01); *H01R 13/26* (2013.01)
USPC ..... 439/74

(58) Field of Classification Search
USPC ..... 439/74, 884, 91, 591, 66
See application file for complete search history.

(56) References Cited

U.S. PATENT DOCUMENTS

| | | | | |
|---|---|---|---|---|
| 6,540,561 | B1 * | 4/2003 | Masumoto | 439/660 |
| 6,997,751 | B2 | 2/2006 | Miyamoto | |
| 7,232,317 | B2 * | 6/2007 | Ookura | 439/74 |
| 7,320,606 | B2 * | 1/2008 | Midorikawa | 439/74 |
| 7,467,954 | B2 * | 12/2008 | Shiu | 439/74 |
| 7,717,719 | B2 * | 5/2010 | Miyazaki et al. | 439/74 |
| 7,726,979 | B2 * | 6/2010 | Lei et al. | 439/74 |
| 7,758,352 | B2 * | 7/2010 | Zeng | 439/74 |
| 7,845,987 | B2 * | 12/2010 | Yamada et al. | 439/74 |
| 8,092,232 | B2 * | 1/2012 | Takeuchi | 439/74 |
| 8,235,733 | B2 * | 8/2012 | Yamashiro et al. | 439/83 |
| 8,469,722 | B2 * | 6/2013 | Huang | 439/74 |
| 2003/0104714 | A1 | 6/2003 | Yeh | |
| 2006/0276060 | A1 | 12/2006 | Takano | |
| 2008/0132121 | A1 | 6/2008 | Van der Steen | |
| 2009/0221157 | A1 | 9/2009 | Midorikawa et al. | |

FOREIGN PATENT DOCUMENTS

| | | |
|---|---|---|
| JP | 2007-053066 A | 3/2007 |
| JP | 2007-317623 A | 12/2007 |
| JP | 2008-270085 | 11/2008 |

OTHER PUBLICATIONS

International Search Report for PCT/US2010/061345.

* cited by examiner

*Primary Examiner* — Renee S Luebke
*Assistant Examiner* — Harshad Patel
(74) *Attorney, Agent, or Firm* — Timothy M. Morella

(57) ABSTRACT

A pair of terminals having a first terminal loaded in a first connector and a second terminal loaded in a second connector mated with the first connector, the terminals coming into contact with each other and being electrified, wherein the first terminal is equipped with a contact portion including a protruding contact protrusion, the second terminal is equipped with a contact portion including a contact recess engaging the contact protrusion, the contact protrusion is equipped with an oblique portion extending obliquely widthwise relative to the contact portion, the contact recess is equipped with an oblique portion extending obliquely widthwise relative to the contact portion, and the oblique portion of the first terminal and the oblique portion of the second terminal cross each other.

13 Claims, 11 Drawing Sheets

FIG. 9A
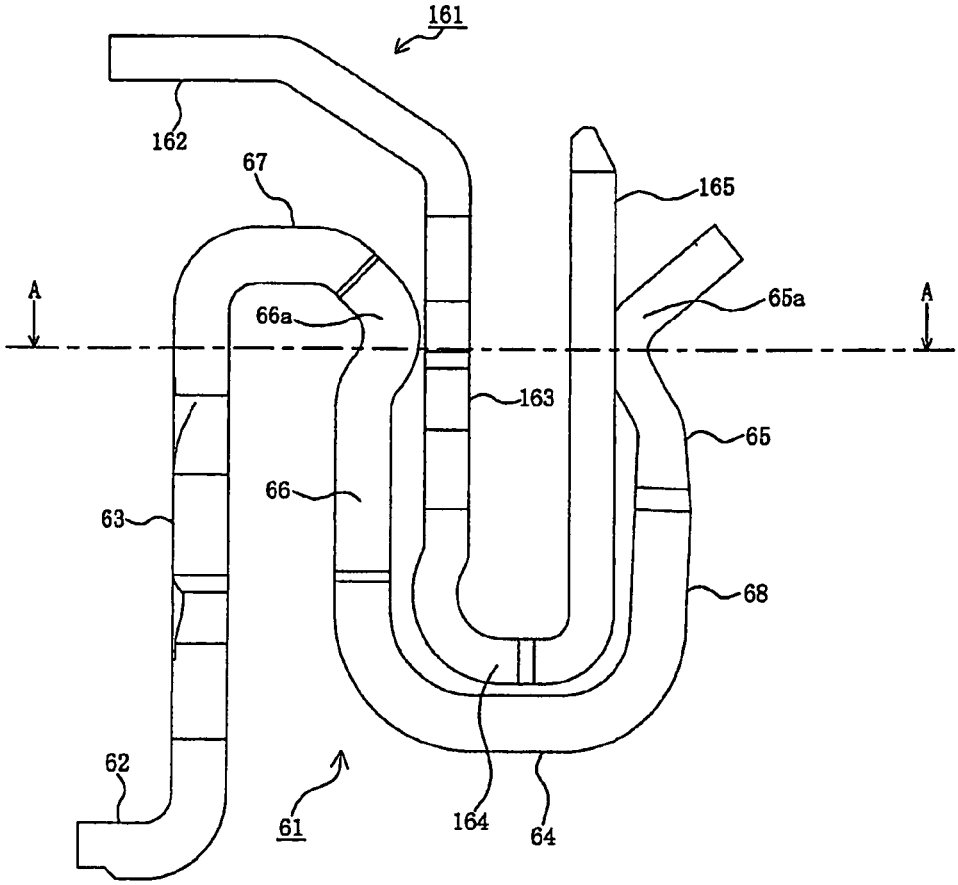
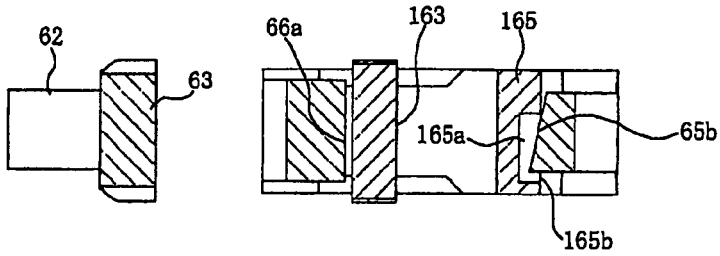
FIG. 9B

TERMINALS

REFERENCE TO RELATED APPLICATIONS

The Present Application claims priority to prior-filed Japanese Patent Application No. 2009-278405, entitled "Terminals," and filed 18 Dec. 2009, the contents of which is fully incorporated in its entirety herein.

BACKGROUND OF THE PRESENT APPLICATION

The Present Application relates generally to terminals loaded in connectors, and, more particularly, to terminals loaded in connectors in which the oblique portion of the terminals are moved, while making point contact so that the oblique portions of the terminals cross each other.

Conventional connectors can be used, for example, to connect a plurality of wires together electrically, to connect a wire (or wires) to a circuit board and to connect a plurality of circuit boards together electrically. When conventional connectors, having a plurality of terminals, are mated, the terminals make contact and are electrified. In order to maintain good contact and a good electrical connection between terminals, the surface of one of the terminals may be recessed, and this recess engages the other terminal to keep the terminals from separating. An example is disclosed in Japanese Patent Application No. 2008-270085.

FIG. 11 is a cross-sectional view of terminals in a conventional connector making contact with each other. In FIG. 11, the first terminal 861 is loaded in the housing 811 of the first connector mounted on a first circuit board, and the second terminal 961 is loaded in the housing 911 of the second connector mounted on a second circuit board. The first terminal 861 is equipped with a tail 862 soldered to a connection pad on the first circuit board, and a first contact portion 865 and a second contact portion 866 making contact with the second terminal 961 in the second connector. Similarly, the second terminal 961 is equipped with a tail 962 soldered to a connection pad on the second circuit board, and a first contact portion 965 and a second contact portion 966 making contact with the first terminal 861 in the first connector. As shown in FIG. 11, when the first connector and the second connector mate, the first contact portion 865 in the first terminal 861 and the first contact portion 965 in the second terminal 961 make contact with each other, and the second contact portion 866 in the first terminal 861 and the second contact portion 966 in the second terminal 961 make contact with each other. In this way, an electrical connection is established between the first terminal 861 and the second terminal 961.

A tiered portion is formed in the second contact portion 966 of the second terminal 961, and the protrusion formed in the second contact portion 866 of the first terminal 861 engages this tiered portion. The second contact portion 866 of the first terminal 861 and the second contact portion 966 of the second terminal 961 function as a locking mechanism, and the first connector and the second connector are reliably mated when the first terminal 861 and the second terminal 861 are locked. When the protrusion formed in the second contact portion 866 of the first terminal 861 engages the tiered portion formed in the second contact portion 966 of the second terminal 961, the protrusion formed in the second contact portion 866 of the first terminal 861 makes a clicking sound when it falls into the recess formed near the tiered portion in the second contact portion 966 of the second terminal 961. This lets the operator know that the mating of the first connector and the second connector is complete.

However, in conventional terminals, when the protrusion formed in the second contact portion 866 of the first terminal 861 falls into the recess formed near the tiered portion in the second contact portion 966 of the second terminal 961, the distance along which the surface of the protrusion rubs against the surface of the recess is very short. As a result, the wiping effect is low and foreign matter adhering to the surface of the recess cannot be effectively removed.

Further, the first terminal 861 and the second terminal 961 are so-called bellows contacts. A rolled metal plate is punched out to obtain a comb-shaped member, consisting of a number of slender bands connected to a carrier plate. The bands are then pressed and bent in the thickness direction of the plate to form a bellows shape, and the bands are separated from the carrier plate. Because the widthwise dimensions (perpendicular to the surface of the figure) are larger than the thickness dimensions in the first terminal 861 and the second terminal 961, the surface of the protrusion formed in the second contact portion 866 of the first terminal 861 and the surface of the recess formed near the tiered portion in the second contact portion 966 of the second terminal 961 are both smooth and wide. Nevertheless, the contact pressure per unit area is small. As a result, adequate wiping cannot be obtained, and foreign matter cannot be effectively removed.

SUMMARY OF THE PRESENT APPLICATION

The purpose of the Present Application is to realize a high wiping effect, lower resistance and improve reliability by moving the oblique portion of the first terminal and the oblique portion of the second terminal, while making point contact so that the oblique portion of the first terminal and the oblique portion of the second terminal cross each other.

The Present Application includes a pair of terminals having a first terminal loaded in a first connector and a second terminal loaded in a second connector mated with the first connector, the terminals coming into contact with each other and being electrified, wherein the first terminal is equipped with a contact portion including a protruding contact protrusion, the second terminal is equipped with a contact portion including a contact recess engaging the contact protrusion, the contact protrusion is equipped with an oblique portion extending obliquely widthwise relative to the contact portion, the contact recess is equipped with an oblique portion extending obliquely widthwise relative to the contact portion, and the oblique portion of the first terminal and the oblique portion of the second terminal cross each other.

The Present Application also includes terminals, wherein the oblique portion of the first terminal is the ridgeline of the contact protrusion, and the oblique portion of the second terminal is the boundary edge between the contact recess and the surface of the contact portion.

The Present Application also includes terminals, wherein the oblique portion of the first terminal is oblique and not parallel relative to the surface of the contact portion of the opposing second terminal, and the oblique portion of the second terminal is oblique and not perpendicular relative to the mating direction of the first connector and the second connector.

The Present Application also includes terminals, wherein the oblique portion of the first terminal is oblique and not perpendicular relative to the mating direction of the first connector and the second connector.

The Present Application also includes terminals, wherein the oblique portion of the first terminal and the oblique portion of the second terminal slide while making point contact when the first connector and the second connector are mated.

In the Present Application, the oblique portion of the first terminal and the oblique portion of the second terminal cross each other. Because this causes the oblique portion of the first terminal and the oblique portion of the second terminal to move while making point contact, a high wiping effect is realized, resistance is lowered and reliability is improved.

BRIEF DESCRIPTION OF TIME FIGURES

The organization and manner of the structure and operation of the Present Application, together with further objects and advantages thereof, may best be understood by reference to the following Detailed Description, taken in connection with the accompanying Figures, wherein like reference numerals identify like elements, and in which:

FIG. 9 illustrates two cross-sectional views of the first terminal of FIG. 4 and the second terminal of FIG. 6 after the mating operation, in which FIG. 9(*a*) is a lateral cross-sectional view and FIG. 9(*b*) is a cross-sectional view from Line A-A in FIG. 9(*a*);

DESCRIPTION OF THE PREFERRED EMBODIMENTS

While the Present Application may be susceptible to embodiment in different forms, there is shown in the Figures, and will be described herein in detail, specific embodiments, with the understanding that the disclosure is to be considered an exemplification of the principles of the Present Application, and is not intended to limit the Present Application to that as illustrated.

In the illustrated embodiments, directional representations—i.e., up, down, left, right; front, rear and the like, used for explaining the structure and movement of the various elements of the Present Application, are relative. These representations are appropriate when the elements are in the position shown in the Figures. If the description of the position of the elements changes, however, it is assumed that these representations are to be changed accordingly.

Figure 1:
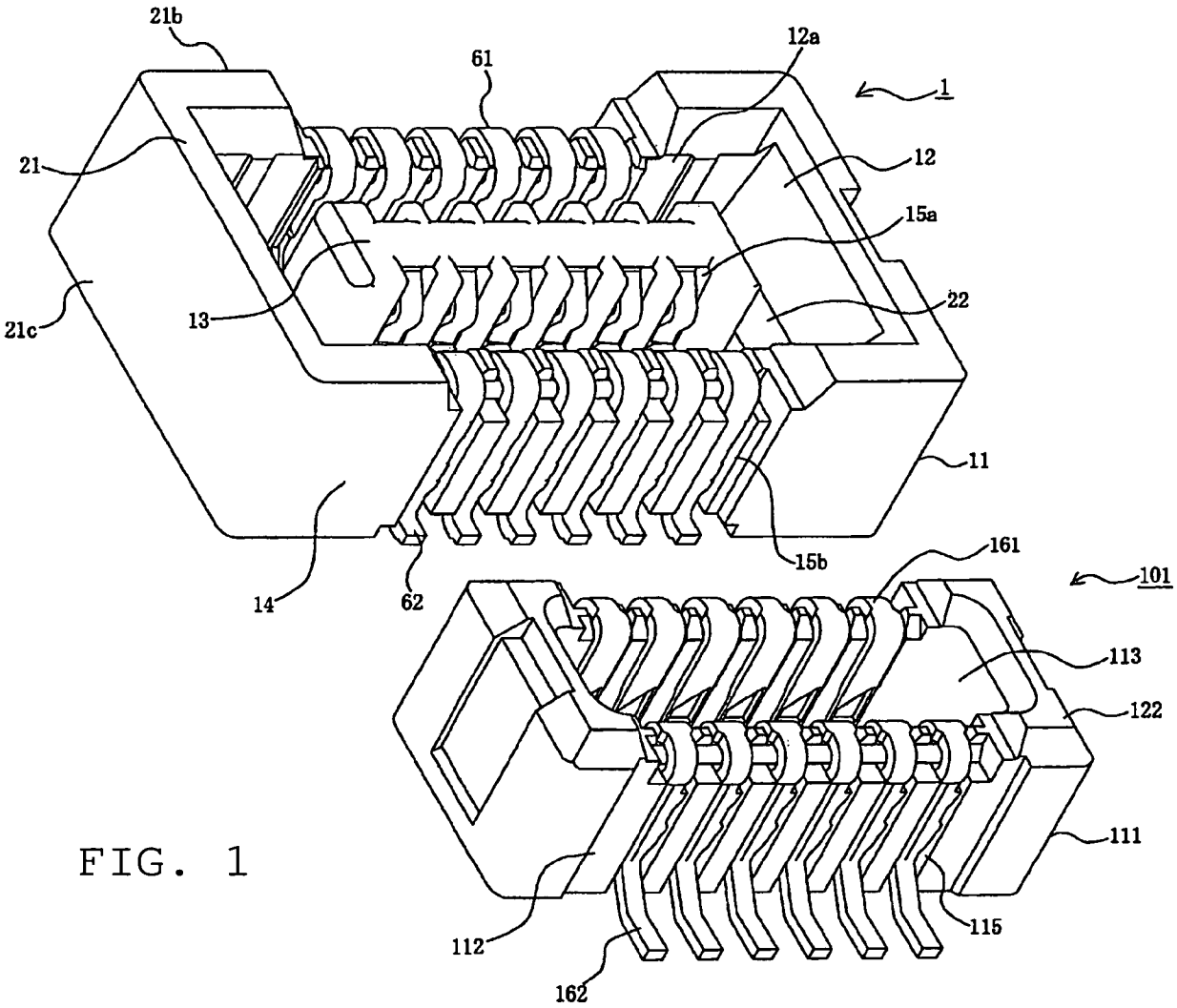
FIG. 1 illustrates a perspective view of the first connector and the second connector of the Present Application.
Figure 2:
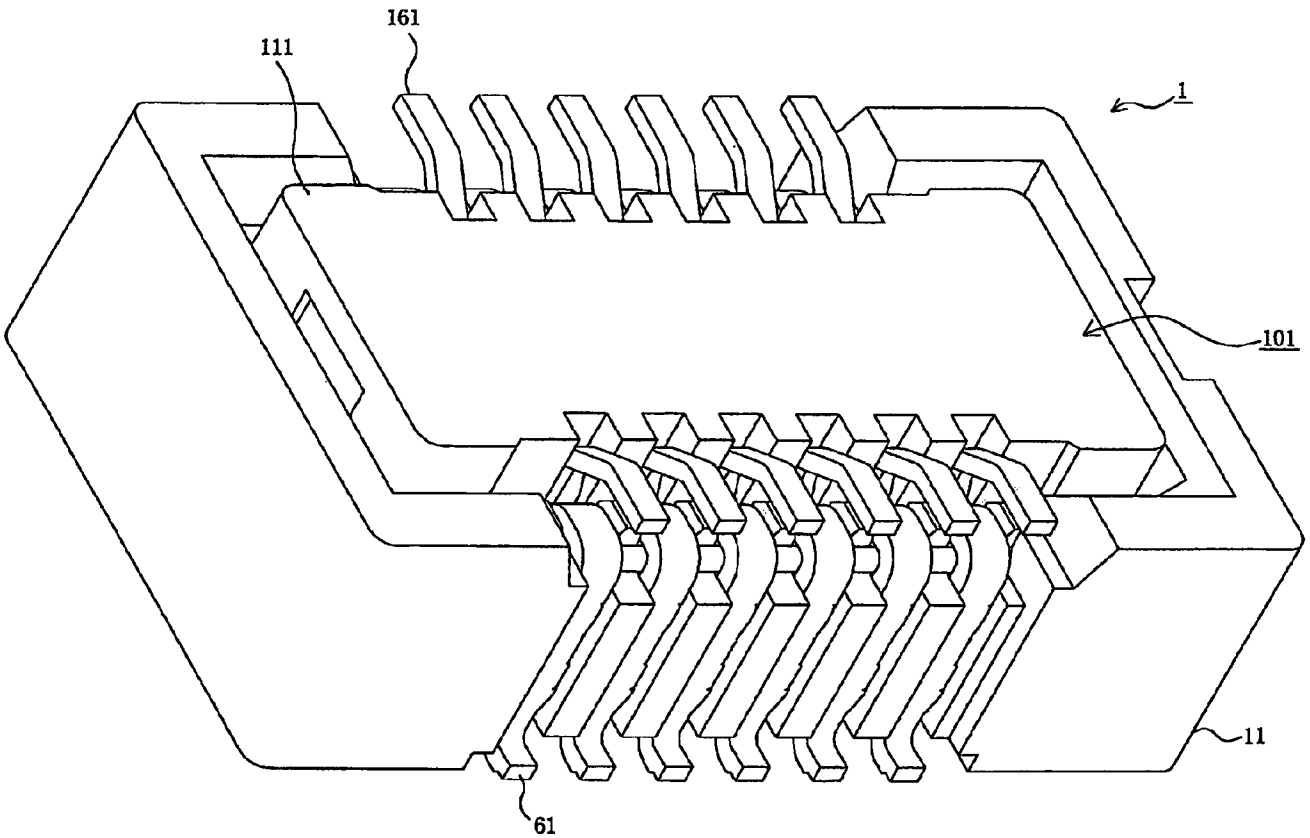
FIG. 2 illustrates a perspective view of the connectors of FIG. 1, mated and from the mating surface of the first connector.
Figure 3:
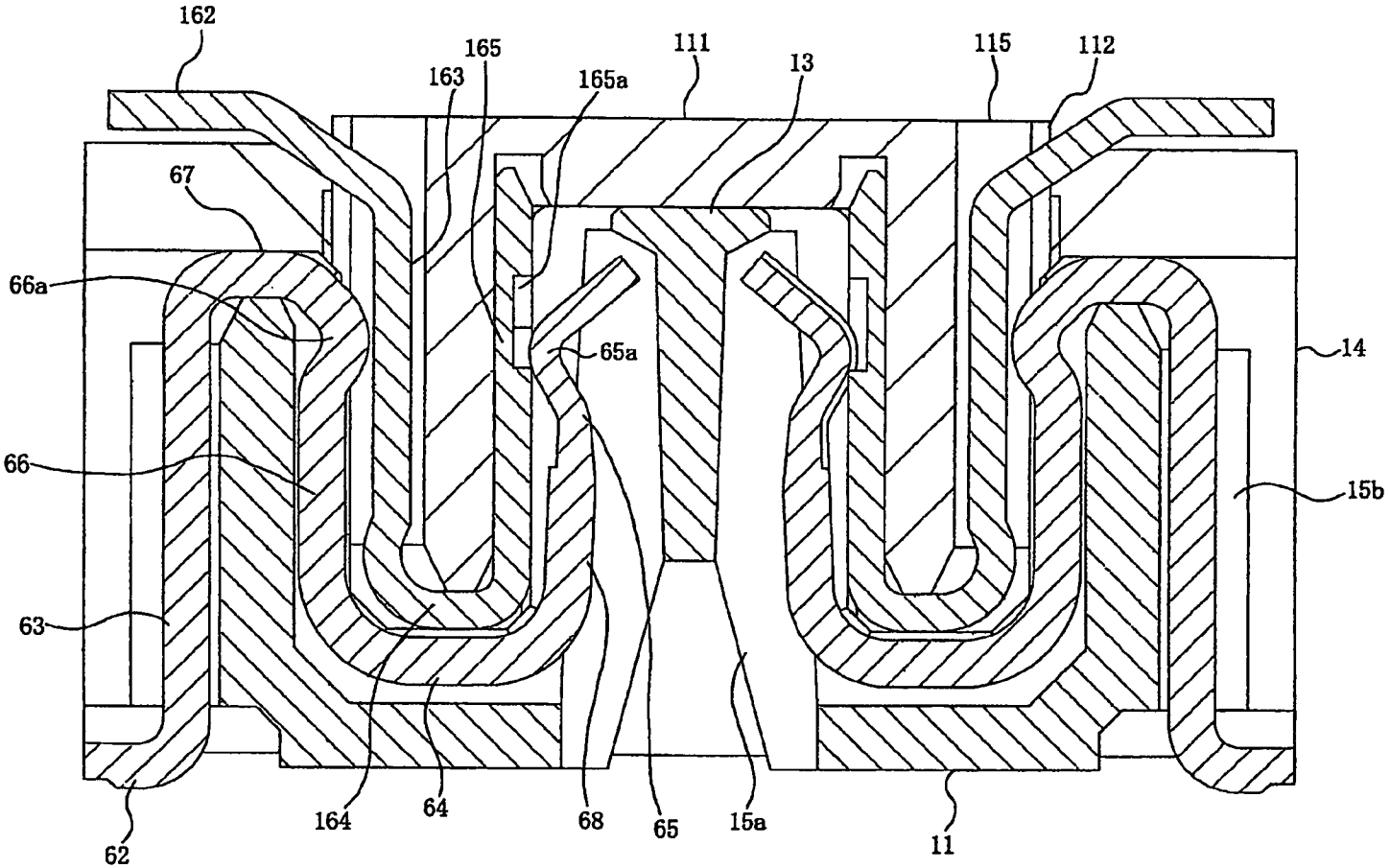
FIG. 3 illustrates a cross-sectional view of the mated connectors of FIG. 1.

Referring to FIGS. 1-3, the first connector 1 being one connector in the embodiment of the Present Application, and the second connector 101 being the other connector. As long as the first connector 1 and the second connector 101 have terminals and that these terminals are connected electrically when the connectors are mated, the connectors can be any type of commonly-used connector. For example, both connectors can be wire-to-wire connectors connected to the ends of wires, or one connector can be a wire-to-board connector connected to the end of a wire and the other can be a wire-to-board connector mounted on a board. For the sake of simplicity, in this explanation, both connectors are board-to-board connectors mounted on boards.

Here, the first connector 1, which is one of the pair of board-to-board connectors, is loaded with the first terminal 61 serving as its terminal. While not shown, this surface-mounted connector is mounted on the surface of the first board. Also, the second connector 101, which is the other one of the pair of board-to-board connectors, is loaded with the second terminal 161 serving as its terminal. While not shown, this surface-mounted connector is mounted on the surface of the second board. The first connector 1 and the second connector 101 are the board-to-board connectors in this embodiment, and are used to electrically connect the first board and the second board. The first board and the second board can be printed circuit boards used in electronic devices or any other type of board.

The first connector 1 has a first housing 11 serving as the connector main body integrally molded from an insulating material. As shown, the first housing 11 is equipped with a substantially rectangular thick, plate-like shape or a substantially rectangular solid. It also has a substantially rectangular recess 12 on the mating side (the upper side in FIG. 1) where it mates with the second connector 101. The first protrusion 13 is integrally formed with the first housing 11 inside the recess 12 as an island. The side wall 14 extending parallel to the first protrusion 13 on both sides of the first protrusion 13 is also integrally formed with the first housing 11. Here, the first protrusion 13 and the side wall 14 extend upward from the bottom surface of the recess 12 and extend lengthwise with respect to the first housing 11. This forms a recessed groove 12*a* in a portion of the recess 12 between the first protrusion 13 and the side wall 14 as a slender insertion recess extending lengthwise with respect to the first housing 11. A single first protrusions 13 is formed in the example shown, but a plurality of protrusions can also be formed.

Here, a recessed first terminal housing inner cavity 15*a* is formed in both side surface of the first protrusion 13. Also, a recessed first terminal housing outer cavity 15*b* is formed in the upper surface and both side surfaces of the side wall 14 in a straddling manner. Because the first terminal housing inner cavities 15*a* and the first terminal housing outer cavities 15*b* are connected and integrated on the bottom surface of the recess 12*a*, the first terminal housing inner cavities 15*a* and the first terminal housing outer cavities 15*b* will be referred to comprehensively as the first terminal housing cavities 15. Six first terminal housing cavities 15 are formed on both sides of the first protrusion 13. The six first terminals 61 housed in each first terminal housing cavity 15 on both sides of the first protrusion 13.

The first terminal 61 is an integrally formed conductive plate that has been formed into a certain shape. It comprises a held portion 63, a tail 62 connected to a bottom end of the held portion 63, an upper connecting portion 67 connected to an upper end of the held portion 63, a second contact portion 66 formed near an inner end of the upper connecting portion 67, a lower connecting portion 64 connected to the second contact portion 66, a cantilevered connecting arm 68 connected to the other end of the lower connecting portion 64, and a first contact portion 65 functioning as the main contact portion formed on a free end of the connecting arm 68.

The held portion 63 is the portion extending vertically in the thickness direction of the first housing 11 that is inserted into and held by a first terminal housing outer cavity 15*b*. The tail 62 is bent towards the held portion 63 and connected. It extends outward horizontally in the width direction of the first housing 11 and is connected by soldering to the connection pad linked to the conductive trace on the first board. The upper connecting portion 67 is bent towards the held portion 63 and connected. It extends inward in the width direction of the first housing 11.

The upper end of the second contact portion 66 extending vertically is bent downward, connected to the inner end of the upper connecting portion 67. The second contact protrusion 66*a* curved and extending inward in the width direction of the first housing 11 is formed near the upper end of the second contact portion 66. The second contact portion 66*a* is positioned on the second contact portion 66 to extend inward. The lower connecting portion 64 has a portion with a U-shaped cross-section connected to the lower end of the second contact portion 66. The first contact portion 65 is formed on the upper or free end of the contact arm 68, and has a first contact protrusion 65*a* extending outward in the width direction of the first housing 11.

The first terminal 61 is inserted into the first terminal housing cavity 15 from the mating side, and the held portion 63 is held on both sides by the inner wall of the first terminal housing outer cavity 15*b* in the side wall 14 and secured in the first housing 11. In this state, when the first terminal 61 has been loaded into the first housing 11, the first contact portion 65 and the second contact portion 66 are positioned horizontally facing both ends of the recess 12*a*.

Because the first terminal 61 is an integrally formed member consisting of a machined metal plate, it has a certain degree of resiliency. It is clear from its shape that the interval between the first contact portion 65 and the second contact portion 66 can change elastically. In other words, when the second terminal 161 on the second connector 101 is inserted between the first contact portion 65 and the second contact portion 66, the interval between the first contact portion 65 and the second contact portion 66 extends elastically.

First projecting ends 21, serving as the first mating guides, are arranged on both ends of the first housing 11 lengthwise. A projecting end recess 22 is formed as a portion of the recess 12 in the first projecting ends 21. The projecting end recesses 22 are rectangular recess connected to both longitudinal ends of the recessed grooves 12*a*. The projecting end recesses 22 function as guide recesses in which the second projecting ends 122 on the second connector 101 are inserted when the first connector 1 and the second connector 101 are mated.

The first projecting end 21 comprises inner wall extensions 21*b* extending from both longitudinal ends of the side wall 14 in the longitudinal direction of the first housing 11, and an end wall 21*c* extending in the short axis direction of the first housing 11 and connecting at both ends to the side wall extensions 21*b*. In the first projecting ends 21, the side wall 21*c* and the side wall extension 21*b* connected at both ends form a connected side wall with a C-shaped cross-section, and demarcate rectangular projecting end recess 22.

The second connector 101 has a second housing 111 serving as the connector main body integrally molded from an insulating material. As shown, the second housing 111 has a rectangular thick, plate-like shape. A slender recessed groove 113 extending lengthwise with respect to the second housing 111 and a second protrusion 112 serving as the slender insertion protrusion extending lengthwise with respect to the second housing 111 and demarcating the outer side of the recessed groove 113 are integrally formed on the mating side (upper side in FIG. 1) or the side on which the first connector 1 on the second housing 111 is inserted. A second protrusion 112 is formed along both sides of the recessed groove 113, and along both sides of the second housing 111. A second terminal 161 is arranged in each second protrusion 112.

For the sake of simplicity, the second connector 101 will be explained with the mating side facing upward and the mounting side facing downward, as shown in FIG. 1. FIGS. 2-3 show the mating side facing downward and the mounting side facing upward. As shown, the recessed groove 113 is sealed on the side mounted on the second board. In other words, the surface on the mounted side (the lower side in FIG. 1) is sealed by the bottom portion.

The second terminal housing cavities 115 are formed in the second protrusion 112 so as to straddle the side surfaces on both sides and the upper surface. A second terminal 161 is housed inside each second terminal housing cavity 115. There are six second terminal housing cavities 115 formed in both sides of the recessed groove 113. There are also six second terminals 161 housed inside the second terminal housing cavities 115 on both sides of the recessed groove 113.

The second terminal 161 is an integrally formed conductive plate that has been formed into a certain shape. It comprises a held portion 163 functioning as the second contact portion, a tail 162 connected to a bottom end of the held portion 163, a connecting portion 164 connected to an upper end of the held portion 163, and a first contact portion 165 functioning as the main contact portion connected to an inner end of the connecting portion 164. A contact recess 165*a*, formed in the surface of the first contact portion 165, engages the first contact protrusion 65*a*.

The held portion 163 extends vertically in the thickness direction of the second housing 111 that is inserted into and held by a second terminal housing cavity 115. The tail 162 is bent towards the held portion 163. It extends outward horizontally in the width direction of the second housing 111 and is connected by soldering to the connection pad linked to the conductive trace on the second board. The connecting portion 164 is bent towards the held portion 163, and extends inward in the width direction of the second housing 111. The first contact portion 165 is bent downward and connected to the inner end of the connecting portion 164. It also extends downward and makes contact with the first contact portion 65 of the first terminal 61. The second terminal 161 is inserted into the second terminal housing cavity 115 from the mating side, and the held portion 163 is held on both sides by the inner wall of the second terminal housing cavity 115 in the side wall and secured in the second housing 111.

Second projecting ends 122 serving as the second mating guides are arranged on both ends of the second housing 111 lengthwise. A second projecting end 122 extends in the short axis direction of the second housing 111, and both ends are connected to both ends of the second protrusion 112 longitudinally. The second projecting end 122 is inserted into the projecting end recess 22 in the first projecting end 21 on the first connector 1 when the first connector 1 is mated with the second connector 101.

Figure 4:
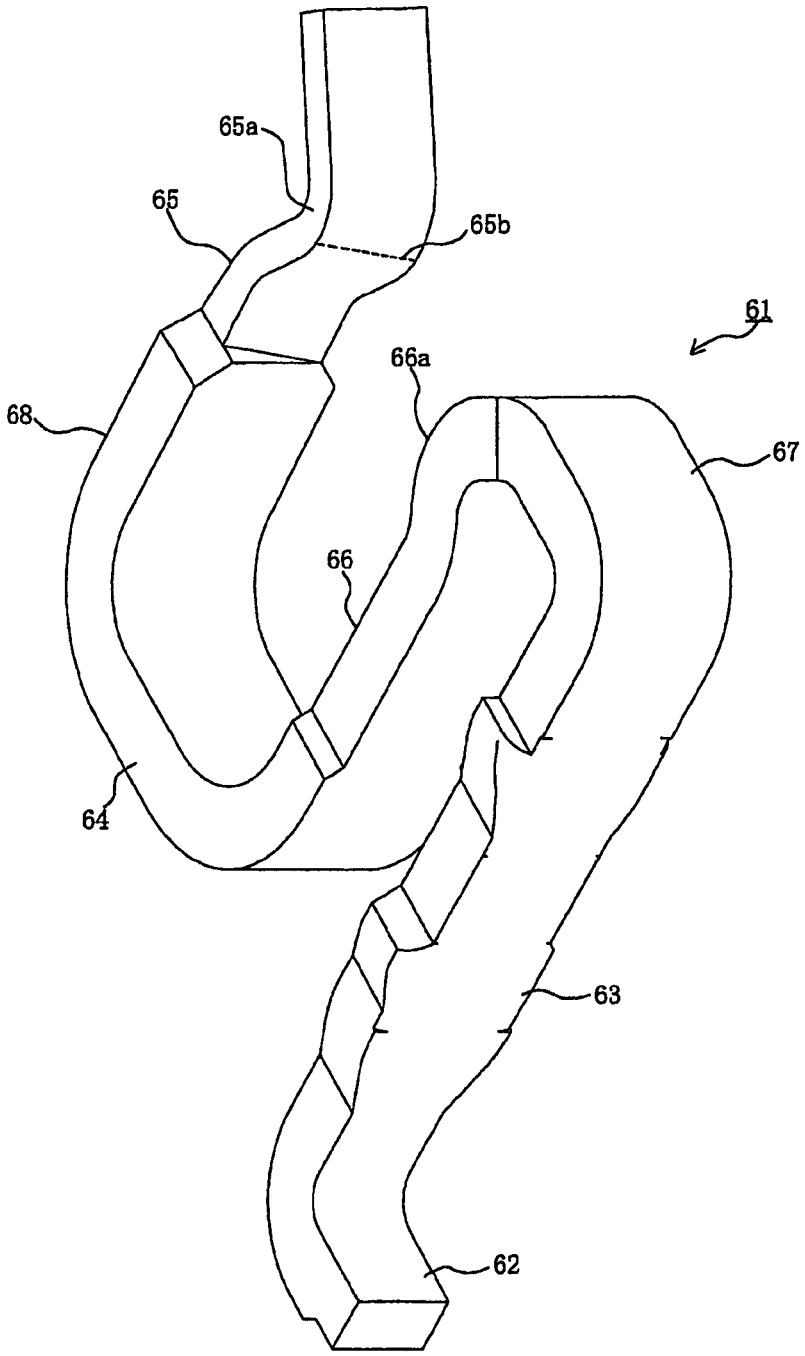
FIG. 4 illustrates a perspective view of the first terminal of the Present Application.
Figure 5:
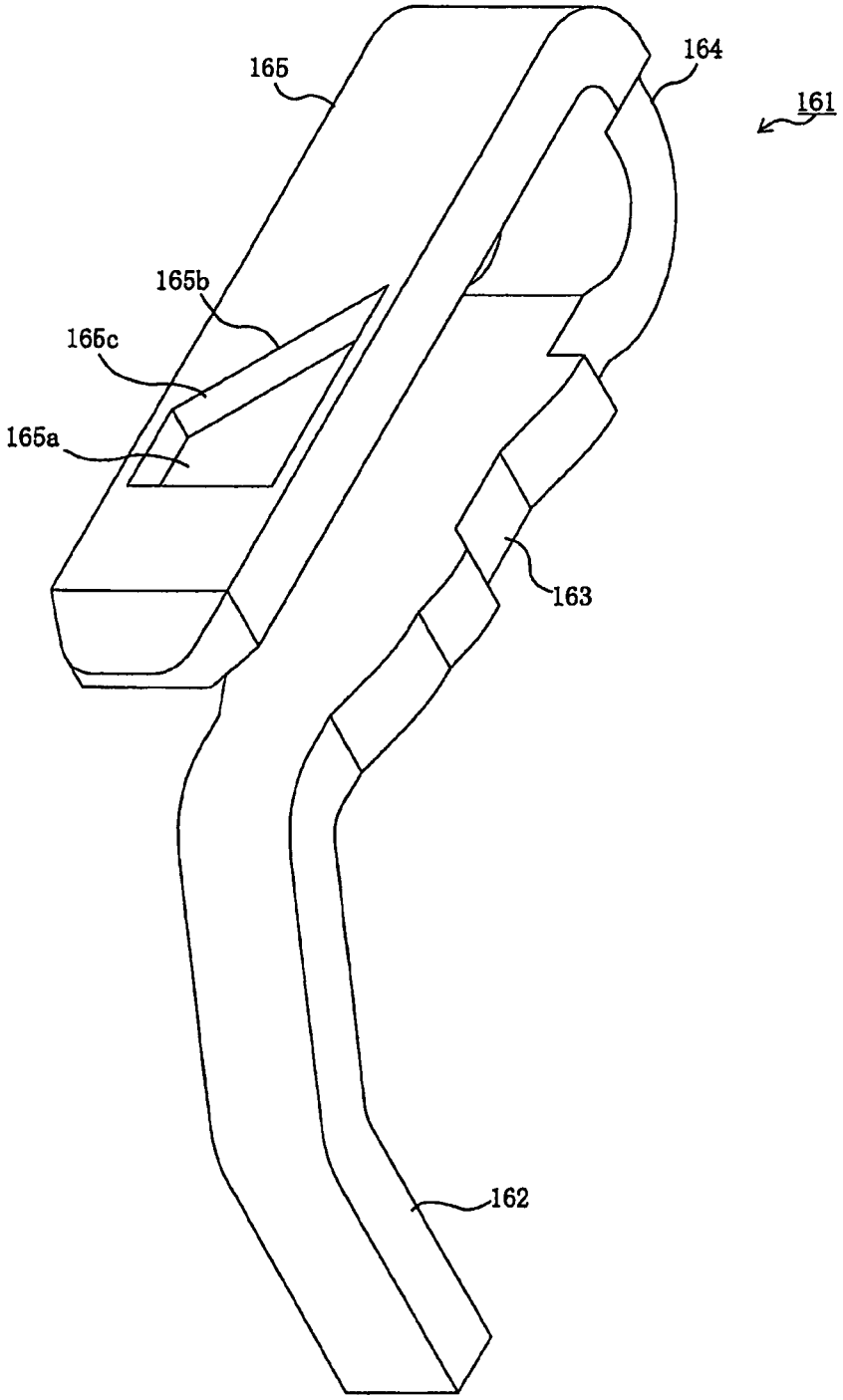
FIG. 5 illustrates a perspective view of the first terminal of the Present Application.

Referring to FIGS. 4-5, which illustrate a more detailed explanation of the configuration of the first terminal 61 and the second terminal 161, the first terminal 61 and the second terminal 61 comprise a rolled metal plate that is shaped like a comb. This consists of a number of slender bands connected to a carrier plate. The slender bands are then formed into a bellows shape in the thickness direction of the plate, and the bands are separated from the carrier plate.

A shown in FIG. 4, the first terminal 61 comprises a cantilevered contact arm 68 connected to one end of the lower connecting portion 64, and a first contact portion 65 formed on the free end of the contact arm 68. The first contact portion 68 has a first contact protrusion 65*a* protruding towards the second contact portion 66. The first contact protrusion 65*a* is a portion of the first contact portion 65 in the slender band that is bent in the thickness direction. It is a linear oblique portion with an inclined ridgeline 65*b* corresponding to the peak.

More specifically, the ridgeline 65*b* extends in the widthwise direction of the first contact portion 65. It is a straight line that is oblique and not parallel to the mating surface of the first housing 11. In other words, the contact arm 68 extends vertically, and the straight line is oblique and not perpendicular to the mating direction of the first connector 1 and the second connector 101. Therefore, the distance from both ends of the ridgeline 65*b* to the mating surface of the first housing 11 is different. As shown in FIG. 3, the ridgeline 65*b* is a straight line that is parallel and not oblique with respect to the surface of the first contact portion 165 of the opposing second terminal 161. In other words, it is a straight line, oblique and not perpendicular to the widthwise direction of the first housing 11. Therefore, the distance from both ends of the ridgeline 65*b* to the surface of the first contact portion 165 of the opposing second terminal 161 is different.

In the example shown, the surface of the first contact portion 65 is inclined with respect to the surface of the contact arm 68 due to the pressure applied to the surface of the first contact portion 65 during the machining process. However, if the ridgeline 65*b* can be inclined, the surface of the first contact portion 65 does not necessarily have to be inclined with respect to the surface of the contact arm 68.

As shown in FIG. 5, the second terminal 161 has a first contact portion 165 connected to one end of the connection portion 164. A contact recess 165*a* is formed in the surface of the first contact portion 165 to engage the first contact protrusion 64*a* in the first contact portion 65 of the first terminal 61. More specifically, the metal plate forming the second terminal 161 is pressed from the surface side of the first contact portion 165 so as to be recessed from the surface of the first contact portion 165. The bottom surface of the contact recess 165*a* is a flat surface substantially parallel to the surface of the first contact portion 165. However, it is connected to the surface of the first contact portion 165 via steep side surfaces. The place where the upper end of the bottom surface of the contact recess 165*a* connects to the surface of the first contact portion 165 is the boundary surface 165*c* of the steep side surface. The edge 165 at the boundary between the upper end of the boundary surface 165*c* and the surface of the first contact portion 165 is a linear oblique portion that is inclined.

More specifically, the straight inclined edge 165*b* extends in the width direction of the first contact portion 165 and is oblique and not parallel to the mating surface of the second housing 111. In other words, the first contact portion 165 extends vertically, oblique and not perpendicular to the mating direction of the first connector 1 and the second connector 101. Therefore, the distance from both ends of the edge 165*b* to the mating surface of the second housing 111 is different. The overall shape of the contact protrusion 165*a* is trapezoidal.

The direction of inclination for the ridgeline 65*b* and the direction of inclination for the edge 165*b* are inverted with respect to each other when the connectors 101 are mated and the first contact portion 65 of the first terminal 61 opposes the first contact portion 165 of the second terminal 161. During mating, when the first contact portion 65 of the first terminal 61 moves in the mating direction with the first contact portion 165 of the second terminal 161, the ridgeline 65*b* and the edge 165*b* move with respect to each other along the ridgeline 65*b* and the edge 165*b* while making point contact. Because they slide along a long distance when subjected to high contact pressure, high wiping action can be obtained and the foreign matter adhering to the surfaces can be effectively removed. Because the edge 165*b* of the second terminal 161 has an especially sharp edge and digs into the ridgeline 65*b* of the first terminal 61, high wiping action can be obtained and the foreign matter adhering to the surfaces can be removed.

FIGS. 6-9 illustrate the operation performed to mate the first contact 1 and the second contact 101 with these configurations. Referring to FIGS. 6-9, the first connector 1 is soldered to the connection pad linked to the conductive trace of the first board not shown in the figure by the tail 62 of the first terminal 61. In other words, the connector is surface-mounted to the first board. Similarly, the second connector 101 is soldered to the connection pad linked to the conductive trace of the second board not shown in the figure by the tail 162 of the second terminal 161. In other words, the connector is surface-mounted to the second board.

Figure 6:
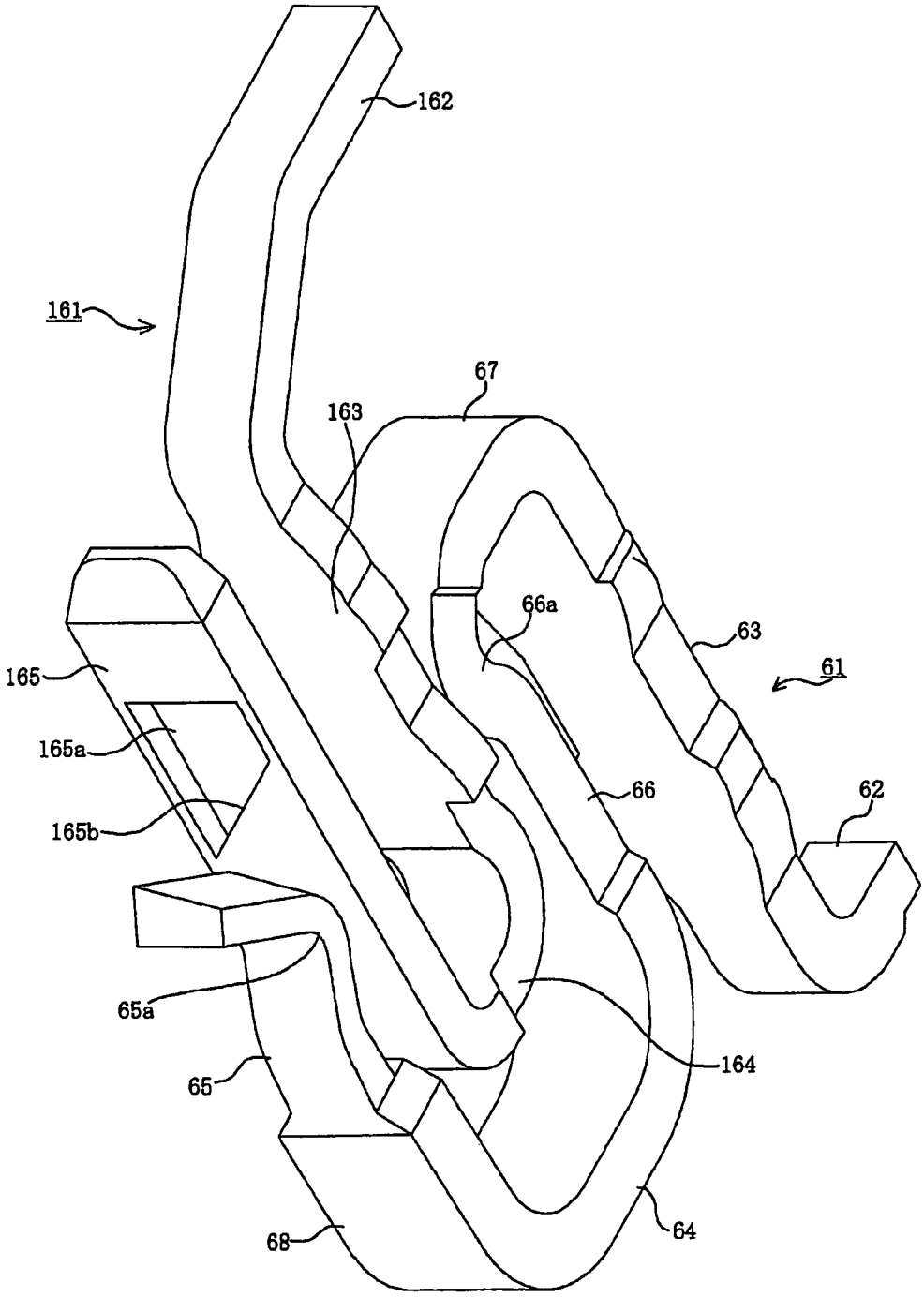
FIG. 6 illustrates a perspective view of the first terminal of FIG. 4 and the second terminal of the Present Application during the mating operation.

First, the operator opposes the mating surface of the first connector 1 to the mating surface of the second connector 101 and aligns the position of the left and right second protrusions 112 of the second connector 101 with the position of the left and right recessed grooves 12*a* in the first connector 1 to complete the positioning of the first connector 1 and the second connector 101. When the first connector 1 and/or the second connector 101 are moved in the mating direction or towards each other, the left and right second protrusions 112 on the second connector 101 are inserted into the left and right recessed grooves 12*a* in the first connector 1. A second terminal 161 on the second connector 101 is inserted between the first contact portion 165 and the second contact portion 66 of the first terminal 61 and, as shown in FIG. 6, the first contact portion 65 of the first terminal 61 contacts the first contact portion 165 of the second terminal 161, and the second contact protrusion 66 of the first terminal 61 contacts the held portion 163 of the second terminal 161. More specifically, the first contact protrusion 65*a* of the first contact portion 65 contacts the surface of the first contact portion 165, and the second contact protrusion 66*a* of the second contact portion 66 contacts the surface of the held portion 163.

The interval between the first contact portion 65 and the second contact portion 66 is pushed apart by the second terminal 161 and elastically expanded. Because the held portion 165 is inserted into the second terminal holding cavity 115 for the second terminal 161 and held, and because the rear surface of the first contact portion 165 contacts or approaches the bottom surface of the second terminal housing cavity 115, the interval between the held portion 163 and the first contact portion 165 hardly changes at all.

Next, when the operator moves the second connector 101 in the mating direction relative to the first connector 1, the first contact protrusion 65*a* on the first contact portion 65 of the first terminal 61 reaches the upper end (the lower end on FIG. 6) of the contact recess 165*a* formed in the surface of the first contact portion 165 of the second terminal 161. As mentioned above, the ridgeline 65*b* of the first contact protrusion 65*a* is oblique and not perpendicular to the mating direction, and oblique and not parallel to the surface of the first contact portion 165 of the second terminal 161. The edge 165*b* at the upper end of the contact recess 165*a* is also oblique and not perpendicular to the mating direction. The direction of inclination of the ridgeline 65*b* and the direction of inclination of the edge 165*b* are inverted with respect to each other when first contact portion 65 opposes first contact portion 165.

Therefore, in FIG. 6, the upper end or the left end of the ridgeline 65*b* of the first contact protrusion 65*a* (not shown)

contacts the lower end or left end of the edge 165*b*. Because the direction of inclination of the ridgeline 65*b* and the direction of inclination of the edge 165*b* are inverted, the ridgeline 65*b* and the edge 165*b* make point contact on the left end in FIG. 6. As the first connector 1 and the second connector 101 move in the mating direction, the portion where the ridgeline 65*b* and the edge 165*b* make point contact moves to the right in FIG. 6. The portion where point contact is made moves to the lower right along the ridgeline 65*b* and to the upper right along the edge 165*b*. When the angle of inclination with respect to the mating direction of the ridgeline 65*b* is $\theta_1$ and the amount of displacement in the mating direction is z, the amount of displacement along the ridgeline 65*b* is $z \cos^{-1}\theta_1$, which is understood to be greater than z. Similarly, when the angle of inclination with respect to the mating direction of the edge 165*b* is $\theta_2$ and the amount of displacement in the mating direction is z, the amount of displacement along the edge 165*b* is $z \cos^{-1}\theta_2$, which is understood to be greater than z. In other words, because the ridgeline 65*b* and the edge 165*b*, respectively, move along the edge 165*b* and the ridgeline 65*b* while making point contact, they slide together along a longer distance than the movement in the mating direction under high contact pressure. This increases the wiping length to obtain a high wiping effect, and the foreign matter adhering to the surfaces can be effectively removed.

Figure 7:
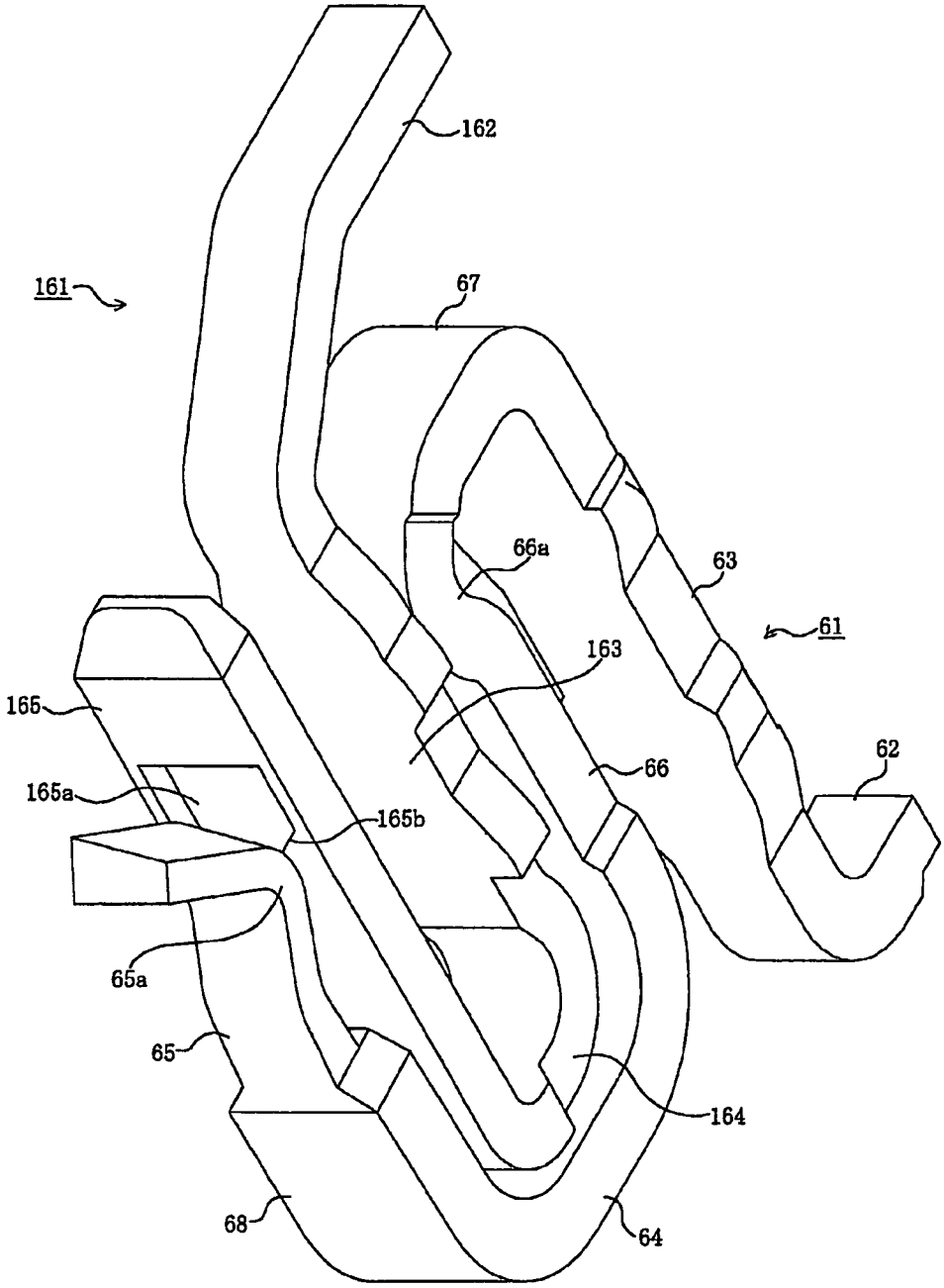
FIG. 7 illustrates a perspective view of the first terminal of FIG. 4 and the second terminal of FIG. 6 after the mating operation.
Figure 8:
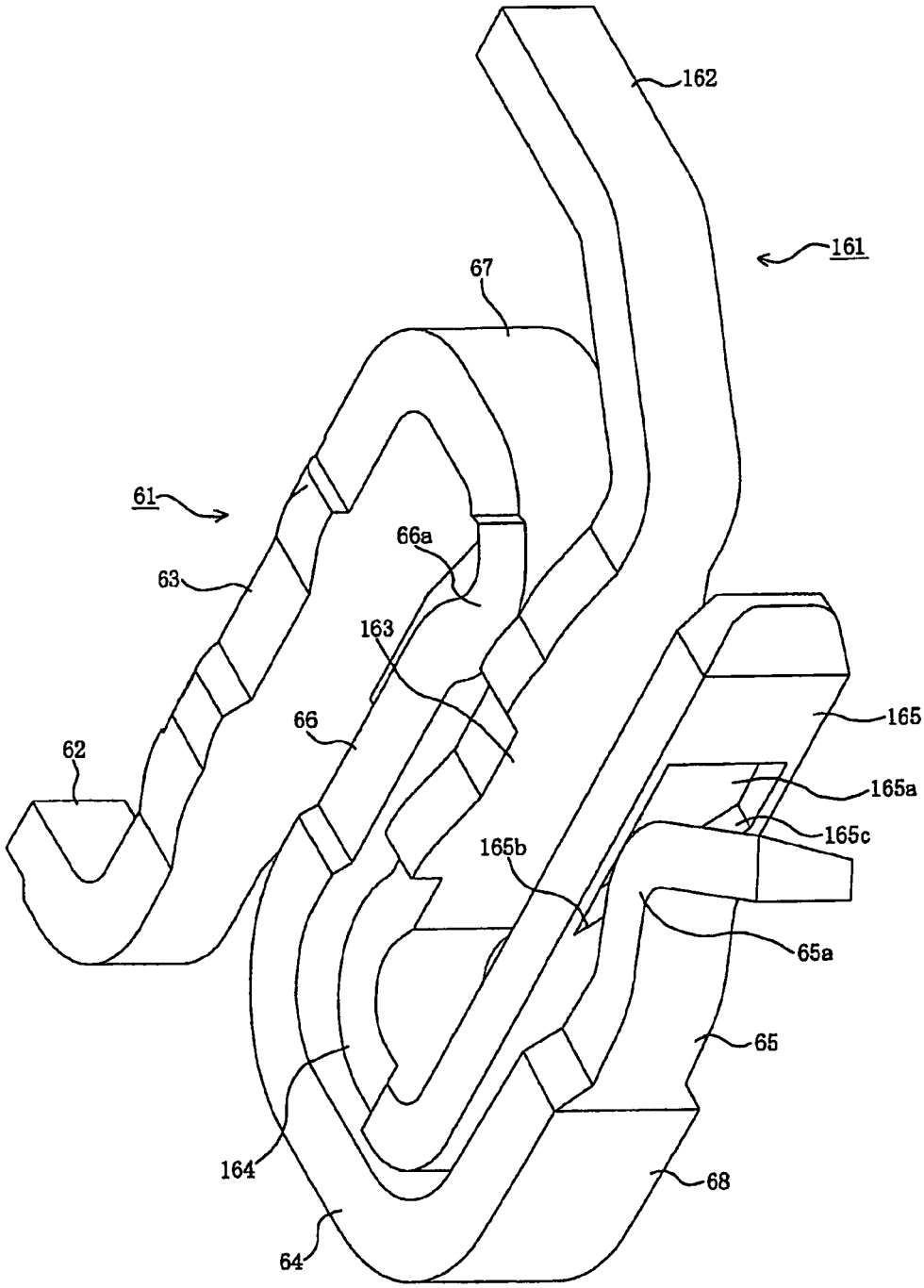
FIG. 8 illustrates another perspective view of the first terminal of FIG. 4 and the second terminal of FIG. 6 after the mating operation.

When the operator moves the second connector 101 in the mating direction relative to the first connector 1, the mating of the first connector 1 and the second connector 101 is completed, as shown in FIG. 3. The relationship between the first terminals 61 and the second terminals 161 is shown in FIGS. 7-9. In this situation, the first contact protrusion 66*a* on the first terminal 61 does not have to be housed entirely inside the contact recess 165*a* of the second terminal 161. However, as described above, because the ridgeline 65*b* of the first contact protrusion 65*a* is oblique and not parallel to the surface of the first contact portion 165 of the opposing second terminal 161, and the left end of the first contact protrusion 65*a* in FIGS. 7-8 (the lower end in FIG. 9*b*) is at least inserted into the contact recess 165*a*. As a result, the first contact protrusion 65*a* of the first terminal 61 is engaged with the contact recess 165*a* of the second terminal 161. Even when the first connector 1 and the second connector 101 are subjected to disengaging force, it is difficult to disengage the second connector 101 from the first connector 1. In other words, a large amount of disengaging force is required.

As shown in FIG. 9, at least a portion of the ridgeline 65*b* of the first contact protrusion 65*a* contacts the edge 165*b*, even when the first contact protrusion 65*a* does not contact the bottom surface of the contact protrusion 165*a*. As a result, an electrical connection is maintained between the first terminal 61 and the second terminal 161. Also, after the portion where the ridgeline 65*b* and the edge 165*b* make contact, the foreign matter adhering to the surfaces has been effectively removed by the wiping action. This makes the electrical connection between the first terminal 61 and the second terminal 161 even more reliable.

Further, as the first terminal 61 is resilient, the interval between the first contact portion 65 and the second contact portion 66 can be pushed apart by the insertion of the second terminal 161. The upper ends of the first contact portion 65 and the second contact portion 66 have a curved shape related to the outside, and the interval between the first contact portion 65 and the second contact portion 66 can be widened even further. The connecting portion 164 of the second terminal 161 and the connecting portions of the held portion 163 and the first contact portion 165 are also curved. Even if the positioning of the first terminal 61 and the second terminal 161 are staggered to some degree with respect to the first connector 1 in the width direction of the second connector 101 (the horizontal direction in FIG. 3), the second terminal 161 slides smoothly between the first contact portion 65 and the second contact portion 66 of the first contact 61 and is automatically aligned when the second connector 101 moves downward. In other words, the configuration is self-aligning.

Because the ridgeline 65*b* of the first terminal 61 and the edge 165*b* of the second terminal 161 are inclined in the reverse direction with respect to each other, even if the first terminal 61 and the second terminal 161 are staggered somewhat with respect to the first connector 1 in the longitudinal direction of the second connector 101 (in the direction perpendicular to the surface of the paper in FIG. 3), when contact begins between the ridgeline 65*b* and the edge 165*b*, the first contact protrusion 65*a* of the first terminal 61 is inserted smoothly into the contact recess 165*a* of the second terminal 161, and become automatically aligned. In other words, the configuration is self-aligning.

In the explanation of the embodiment, the ridgeline 65*b* of the first contact protrusion 65*a* is oblique and not perpendicular to the mating direction, and is oblique and not parallel to the surface of the first contact protrusion 165 of the opposing second terminal 161. However, the ridgeline 65*b* of the first contact portion 65*a* does not have to be oblique with respect to the mating direction. In other words, the ridgeline 65*b* of the first contact protrusion 65*a* can be oblique and not parallel to the first contact portion 165 of the opposing second terminal 161, and perpendicular to the mating direction.

Thus, this embodiment comprises a pair of terminals having a first terminal 61 loaded in a first connector 1 and a second terminal 161 loaded in a second connector 101 mated with the first connector 1, the terminals coming into contact with each other and being electrified. The first terminal 61 is equipped with a first contact portion 65 including a first protruding contact protrusion 65*a*, the second terminal 161 is equipped with a first contact portion 165 including a contact recess 165*a* engaging the first contact protrusion 65*a*, the first contact protrusion 65*a* is equipped with ridgeline 65*b* extending obliquely widthwise relative to the first contact portion 65, the contact recess 165*a* is equipped with an edge 165*b* extending obliquely widthwise relative to the first contact portion 165, and the ridgeline 65*b* of the first terminal 61 and the edge 165*b* of the second terminal 161 cross each other. Thus, when the first connector 1 and the second connector 101 are mated, a high wiping effect is realized. The debris adhering to the first contact portion 65 of the first terminal 61 and the first contact portion 165 of the second terminal 161 such as a film of impurities can be effectively removed, the electrical resistance between the first terminal 61 and the second terminal 161 is lowered, and reliability is improved.

In this embodiment, the ridgeline 65*b* of the first terminal 61 is oblique and not parallel to the surface of the first contact portion 165 of the opposing second terminal 161, and the edge 165*b* of the second terminal 161 is oblique and not perpendicular to the mating direction of the first connector 1 and the second connector 101. Because the ridgeline 65*b* and the edge 165*b* make contact with each other while sliding, respectively, along the edge 165*b* and the ridgeline 65*b*, the slide together for a longer distance than they move in the mating direction under high contact pressure. This increases the wiping length, and provides a high wiping effect. The foreign matter adhering to the surfaces can thus be effectively removed. Because the first contact portion 65*a* of the first terminal 61 engages the contact recess 165*a* in the second element 161, the first connector 1 is difficult to disengage from the second connector 101 even when the mated first connector 1 and second connector 101 are subjected to disengaging force.

Further, the ridgeline 65*b* of the first terminal 61 is oblique and not perpendicular to the mating direction of the first connector 1 and the second connector 101. This further increases the wiping length, realizes an even higher wiping effect and more effectively removes foreign matter adhering to the surfaces. Also, when the first connector 1 and the second connector 101 mate, the ridgeline 65*b* of the first terminal 61 and the edge 165*b* of the second terminal 161 slide in point contact with each other. Because the ridgeline 65*b* of the first terminal 61 and the edge 165*b* of the second terminal 161 increase contact pressure, a high wiping effect can be realized.

Figure 10:
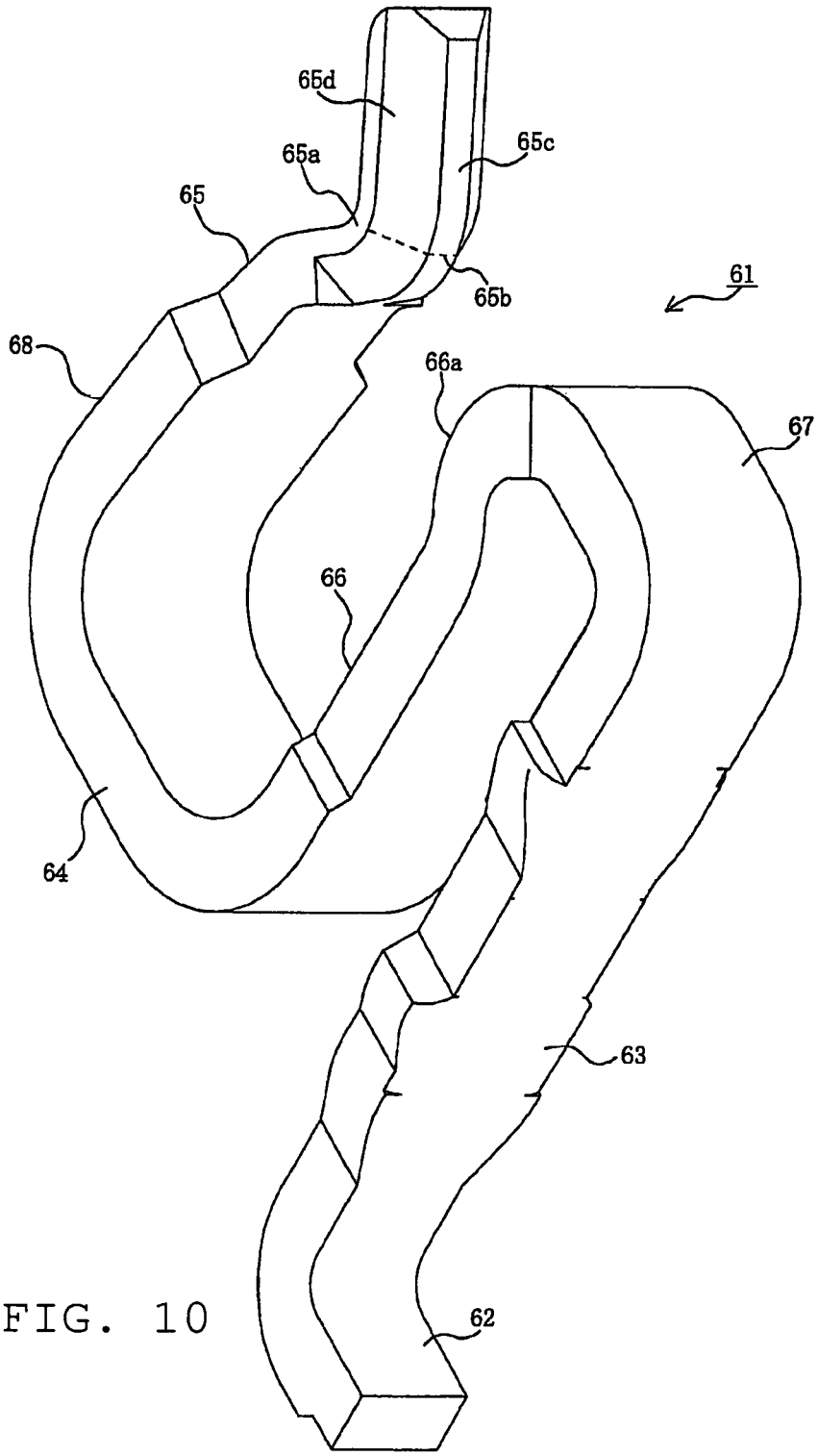
FIG. 10 illustrates a perspective view of the first terminal of FIG. 5.
Figure 11:
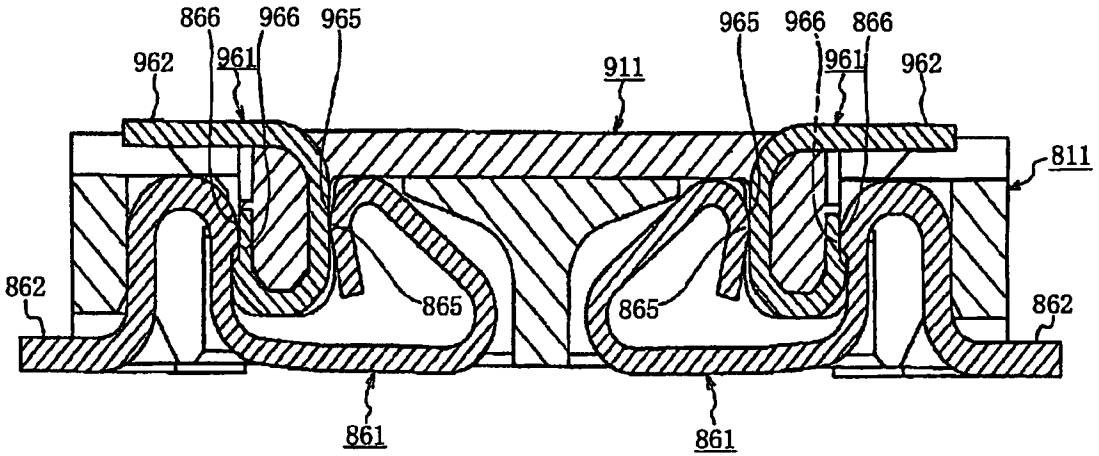
Prior Art FIG. 11
FIG. 11 illustrates a cross-sectional view of contact between terminals in conventional connectors.

With reference to FIG. 10, which is a description of an alternative embodiment of the Present Application, the components in the configuration that are identical to those in the previous embodiment are denoted by the same numbers, and further explanation is omitted. Explanations of actions and effects that are identical to those in the previous embodiment are also omitted. Referring to FIG. 10, the first terminal 61 comprises a cantilevered contact arm 68 connected to one end of a lower connecting portion 64, and a first contact portion 65 formed in the free end of the contact arm 68. The first contact portion 65 is equipped with a first contact protrusion 65 protruding towards the second contact portion 66.

A tapered surface 65*d* is pressed near both ends widthwise along nearly the entire first contact portion 65, at least along the entire first protruding portion 65*a*. This is the surface that opposes the second contact portion 66, or the first contact portion 165 of the second terminal 161. The portion between the tapered surface 65*d* at both ends is a contact surface 65*c* with a narrow width. This contact surface 65*c* is closer to the second contact portion 66 than the tapered surfaces 65*d* at both ends. As a result, the contact surface 65*c* of the first contact portion 65*a* makes contact with the first contact portion 165 of the second terminal 161 when the first connector 1 and the second connector 101 are mated.

The portion of the ridgeline 65*b* containing the contact portion 65*c* is oblique and corresponds to the peak of the first contact protrusion 65*a*. However, the ridgeline itself is straight and is not oblique. In other words, in this embodiment, the ridgeline 65*b* extends in the width direction of the first contact portion 65, and is parallel and not oblique with respect to the mating surface of the first housing 11. In other words, the contact arm 68 extends vertically, and perpendicular to the mating direction of the first connector 1 and the second connector 101. Therefore, the distance from both ends of the ridgeline 65*b* to the mating surface of the first housing 11 is different. The portion of the ridgeline 65*b* including the contact surface 65*c* is a straight line parallel to the surface of the first contact portion 165 of the second terminal 161. That is, it is perpendicular and not oblique widthwise relative to the first housing 11. Therefore, the distances from both ends of the portion of the ridgeline 65*b* including the contact surface 65*c* to the surface of the opposing contact portion 165 of the second terminal 161 are different.

In contrast, the portions of the ridgeline 65*b* including the left and right tapered surfaces 65*d* are straight lines that are oblique and not parallel to the surface of the first contact portion 165 of the second terminal 161. In other words, they are oblique and not perpendicular widthwise relative to the first housing 11. Therefore, the distances from both ends of the portions of the ridgeline 65*b* including the left and right tapered surfaces 65*d* to the surface of the opposing contact portion 165 of the second terminal 161 are different. Thus, when the first and second connectors 1, 101 mate, the contact surface 65*c* of the first contact protrusion 65*a* in the first contact portion 65 of the first terminal 61 makes contact with the surface of the first contact portion 165 of the second terminal 161. The edge 165*b* on the upper end of the contact recess 165*a* formed in the surface of the first contact portion 165 makes contact with the portion of the ridgeline 65*b* including the contact surface 65*c*, but the portion of the ridgeline 65*b* including the tapered surface 65*d* can also make contact.

While a preferred embodiment of the Present Application is shown and described, it is envisioned that those skilled in the art may devise various modifications without departing from the spirit and scope of the foregoing Description and the appended Claims.

What is claimed is:

1. A pair of terminals, the pair of terminals comprising:

a first terminal, the first terminal being loaded in a first connector; and a second terminal, the second terminal being loaded in a second connector, the second connector being mated with the first connector, the terminals coming into contact with each other and being electrified;

wherein:

the first terminal is equipped with a first terminal first contact portion and a first terminal second contact portion, the first terminal first contact portion including a first contact protrusion, the first terminal second contact portion including a second contact protrusion;

the second terminal is equipped with a second terminal contact portion, the second terminal contact portion including a contact recess, the contact recess engaging the first terminal first contact protrusion;

the first terminal first contact protrusion and the first terminal second contact portion are each equipped with first terminal oblique portions, the first terminal oblique portions extending obliquely widthwise relative to the respective contact portion;

the contact recess is equipped with a second terminal oblique portion, the second terminal oblique portion extending obliquely widthwise relative to the second terminal contact portion; and the first terminal first contact oblique portion and the second terminal oblique portion cross each other.

2. The terminals of claim 1, wherein the first terminal first contact oblique portion and the second terminal oblique portion slide while making contact when the first connector and the second connector are mated.

3. The terminals of claim 1, wherein the first terminal first contact oblique portion is oblique and not parallel relative to the surface of the second terminal contact portion.

4. The terminals of claim 3, wherein the second terminal oblique portion is oblique and not perpendicular relative to the mating direction of the first connector and the second connector.

5. The terminals of claim 4, wherein the first terminal first contact oblique portion and the second terminal oblique portion slide while making contact when the first connector and the second connector are mated.

6. The terminals of claim 1, wherein the first terminal first contact oblique portion is the ridgeline of the first contact protrusion, and the oblique portion of the second terminal is the boundary edge between the contact recess and the surface of the contact portion.

7. The terminals of claim 6, wherein the second terminal oblique portion is the boundary edge between the contact recess and the surface of the second terminal contact portion.

8. The terminals of claim 7, wherein the first terminal first contact oblique portion and the second terminal oblique portion slide while making contact when the first connector and the second connector are mated.

9. The terminals of claim 7, wherein the first terminal first contact oblique portion is oblique and not parallel relative to the surface of the second terminal contact portion.

10. The terminals of claim 9, wherein the second terminal oblique portion is oblique and not perpendicular relative to the mating direction of the first connector and the second connector.

11. The terminals of claim 10, wherein the first terminal first contact oblique portion and the second terminal oblique portion slide while making contact when the first connector and the second connector are mated.

12. The terminals of claim 10, wherein the first terminal first contact oblique portion is oblique and not perpendicular relative to the mating direction of the first connector and the second connector.

13. The terminals of claim 12, wherein the first terminal first contact oblique portion and the second terminal oblique portion slide while making contact when the first connector and the second connector are mated.

* * * * *